US007293653B2

(12) United States Patent
Von Falkenhausen

(10) Patent No.: US 7,293,653 B2
(45) Date of Patent: Nov. 13, 2007

(54) PRIMARY PACKAGING UNIT FOR A PLURALITY OF INDIVIDUAL FILM TABLETS AS PHARMACEUTICAL FORMS

(75) Inventor: Christian Von Falkenhausen, Meckenheim (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 250 days.

(21) Appl. No.: 10/466,905

(22) PCT Filed: Jan. 14, 2002

(86) PCT No.: PCT/EP02/00287

§ 371 (c)(1),
(2), (4) Date: Oct. 7, 2003

(87) PCT Pub. No.: WO02/059012

PCT Pub. Date: Aug. 1, 2002

(65) Prior Publication Data

US 2004/0050749 A1 Mar. 18, 2004

(30) Foreign Application Priority Data

Jan. 23, 2001 (DE) ..... 101 02 818

(51) Int. Cl.
*B65D 83/04* (2006.01)

(52) U.S. Cl. ..... 206/538; 206/534.1; 206/532

(58) Field of Classification Search ..... 206/531, 206/532, 534.1, 538, 539
See application file for complete search history.

(56) References Cited

U.S. PATENT DOCUMENTS 3,503,493 A * 3/1970 Nagy ..... 206/232
3,743,084 A 7/1973 Douglas
3,941,248 A * 3/1976 Moser et al. ..... 206/531
4,305,502 A * 12/1981 Gregory et al. ..... 206/532
4,398,634 A * 8/1983 McClosky ..... 206/532
5,046,618 A * 9/1991 Wood ..... 206/532
5,325,968 A * 7/1994 Sowden ..... 206/532
5,358,118 A * 10/1994 Thompson et al. ..... 206/538
5,620,088 A 4/1997 Martin et al.
5,775,505 A * 7/1998 Vasquez et al. ..... 206/538
5,899,335 A 5/1999 Boyer et al.

(Continued)

FOREIGN PATENT DOCUMENTS

AU 736498 B2 7/1999

(Continued)

*Primary Examiner*—David T. Fidei
(74) *Attorney, Agent, or Firm*—Birch, Stewart, Kolasch & Birch, LLP

(57) ABSTRACT

The invention relates to a primary package unit for a plurality of separated film laminas as administration forms, having a bottom layer and a top layer sealed thereto, between which layers individual compartments, surrounded by sealed areas, are formed for the administration forms in the region of which the top and bottom layers are unsealed. The invention achieves the object of configuring such a primary package unit in such a manner that the same makes possible a more densely packed package for, in particular round, film laminas as administration forms. To this end, the primary package unit is provided with at least two rows (I, II) of compartments (4, 8), and said compartments (4, 8) and the administration forms (1) of neighboring rows (I, II) are offset from one another.

6 Claims, 2 Drawing Sheets

U.S. PATENT DOCUMENTS

Figure 1:
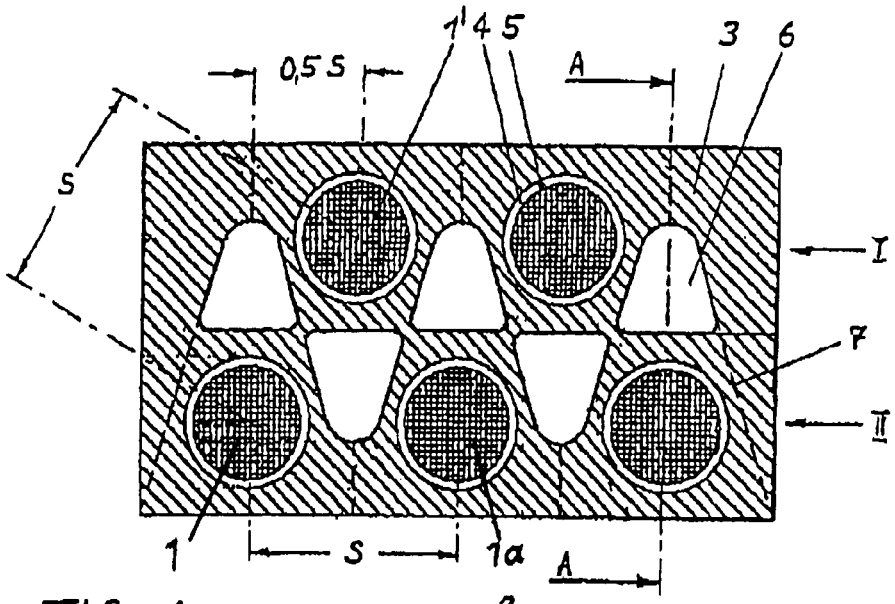

| | | | | |
|---|---|---|---|---|
| 6,036,016 | A * | 3/2000 | Arnold | 206/532 |
| 6,155,423 | A * | 12/2000 | Katzner et al. | 206/531 |
| 6,375,956 | B1 * | 4/2002 | Hermelin et al. | 424/400 |

FOREIGN PATENT DOCUMENTS

| | | | |
|---|---|---|---|
| CH | 655 913 | A5 | 5/1986 |
| DE | 29 19 713 | A | 11/1980 |
| DE | G 89 02 268.8 | U1 | 5/1989 |
| DE | 198 00 682 | A1 | 7/1999 |
| DE | 100 08 165 | A1 | 8/2001 |
| EP | 0 389 207 | A1 | 9/1990 |
| EP | 0 734 965 | A | 10/1996 |
| FR | 2 760 436 | A | 9/1998 |
| FR | 2 778 893 | A | 11/1999 |

* cited by examiner

Schnitt A-A

PRIMARY PACKAGING UNIT FOR A PLURALITY OF INDIVIDUAL FILM TABLETS AS PHARMACEUTICAL FORMS

This application is the national phase under 35 U.S.C. § 371 of PCT International Application No. PCT/EP02/00287 which has an International filing date of Jan. 14, 2002, which designated the United States of America.

BACKGROUND OF THE INVENTION

1. Field of the Invention

The invention relates to a primary package unit for a plurality of separated film laminas as administration forms, which film laminas are arranged in said primary package unit in compartments formed in a plurality of rows especially for circular administration forms.

2. Description of the Related Art

Medicaments in solid form are as a rule separated to form dosage units (administration forms) and packed individually in primary packages in a predetermined number, and dispensed to the patient or consumer as a so-called card containing the administration forms between at least two layers which are sealed to one another. Apart from the known solid administration forms for medicaments, such as tablets or coated tablets there is also the administration form of the "wafer". This is a film lamina of, for example, a polymer component and an active substance, with a predetermined amount of active substance, which lamina is adapted in terms of its thickness and its dimensions to the active substance amount to be released. In DE 198 00 682 is described a primary pack for such film laminas. This primary pack has a bottom layer and a top layer, between which wafer-shaped film laminas, as administration forms, are enclosed in compartments. The top and bottom layers are joined to one another by sealed seams or sections, wherein, in the regions between the compartments, perforations are introduced as predetermined breaking lines, which, when required, allow detachment of the individual compartments from the primary package unit. To facilitate gripping and tearing open, an unsealed margin can be provided next to each compartment at least one side outside the sealed region, or the top and bottom layers may be offset against each other and joined to one another such that a projecting margin is formed of one of the two layers.

Furthermore, DE 100 08 165 has a primary package unit with a bottom layer and a top layer as its subject matter. In this packaging unit, the two layers are, in predetermined regions, not connected with each other and thereby form an aid for tearing open.

Because of the sheet-like extent of the pharmaceutical preparation, the extent of a free space surrounding the administration form, and the width of the sealed region, primary package units according to DE 198 00 682 reach an extent which impairs handling thereof. Thus, for example, a card (primary package unit) with five wafer-shaped administration forms each having a surface area of 2 $cm^2$, has an overall width of 11 cm and a width of 6 cm. It is difficult to accommodate this card in a purse, for example. A package for one week, with at least 7 administration forms, would thus be even less favourable. The reason for this is the size of the wafer-like administration forms, which substantially have a diameter of 1.5 cm, which leads to a lower packing density in the primary package unit, all the more so as the administration forms must be tightly sealed therein. However, a good handling property, including easy accommodation when carrying the pack, is precisely a declared aim of this new administration form, which is, in particular, offered and administered in a round (wafer-shaped) form in order to suggest a certain proximity to other administration forms and facilitate its establishment.

SUMMARY OF THE INVENTION

It is therefore an object of the present invention to configure a primary package unit such that the primary package unit enables a more densely packed package for, especially round, administration forms.

This object is achieved in a package unit for a plurality of separated film laminas as administration forms, having a bottom layer and a top layer sealed thereto, between which layers individual compartments, surrounded by sealed regions, are formed for the administration forms in the region of which the top and bottom layers are unsealed.

The invention consists in that—in a primary package unit for a plurality of separated administration forms in the form of film laminas formed of a bottom layer and a top layer sealed to said bottom layer, between which layers individual compartments, surrounded by sealed regions, for the administration forms are formed, in the area of which the top and bottom layers are unsealed—at least two rows of compartments are formed and the compartments and administration forms of the neighbouring rows are arranged offset from one another, or in that, as an alternative, the compartments are arranged in the form of a ring. The positioning in several rows with offset compartments or, also, the ring-shaped positioning of the administration forms leads to a denser packaging per unit area and thereby also to smaller primary package units.

Preferably, the primary package unit is intended to be used for round wafer-shaped film laminas as administration form, with the compartments being arranged such that the offset of the administration forms enclosed in the compartments equals half the distance between the centre points of two neighbouring administration forms of a row, and that all neighbouring administration forms have the same distance from one another. This means that given a distance A between two adjacent administration forms in a row, an administration form of the neighbouring row is offset from these administration forms by 0.5 A. In addition, the connecting lines of the centre points of the administration forms form isosceles triangles. Depending on the embodiment of the invention, however, the offset may also be chosen to be different. In the preferred embodiment, the distance between the borders of two adjacent administration forms is between 3 mm and 50 mm, preferably between 6 mm and 20 mm. The administration forms are preferably circular administration forms with a diameter between 0.5 and 3 cm and with a thickness between 50 and 700 μm.

To improve handling, the primary pack is provided with tear-off tabs formed by the top layer not being connected with the bottom layer within the region of said tabs, and by the top layer, in the region averted from the compartments, being separated from the top layer that is sealed to the bottom layer. The tear tabs verge on predetermined tear lines arranged in the sealed upper layer of the regions surrounding the compartments. With the aid of a tear tab, the top layer is separated from the bottom layer along a predet rmined tear line surrounding a compartment, and the respective compartment is opened. The administration form lying in the compartment is thus accessible. If the compartments are arranged in rows, the tear tabs are advantageously arranged such that they project into the intermediate spaces existing between the compartments of a neighbouring row. In the case of compartments arranged in ring shape, the tear tabs are formed in the region surrounded by the compartments, and are directed towards the centre of the round primary package unit, where they can be easily gripped. The neighbouring compartments remain unaffected and closed when a compartment is torn open.

Suitable materials for the two layers are, in particular, polyethylene (PE), polyethylene terephthalate (PET), polypropylene (PP) and ethylene-vinyl acetate copolymer (EVA), but also paper, aluminium or composits of these materials. The top and bottom layers can be made of different materials. It may also be advantageous to use a transparent material for one of the two layers or only for the top layer.

The primary package unit is produced by drawing a web-shaped medicament form from a stock roll and feeding the same towards a web of the bottom layer material, which is likewise drawn from a stock roll, and by punching or cutting out from the medicament web the administration forms, especially circular administration forms, according to the predetermined arrangement in the primary pack, and separating the remaining material by guiding the web of remaining material over a separating edge whereat the administration forms, detached from the composite, remain on the web of the bottom layer material and are advanced along with the same. Subsequent to the separation, a web of the top layer material is fed onto the bottom web and the administration forms positioned thereon, and this web is sealed with the material of the bottom layer in predetermined regions. Thereafter the top web is punched through and partially punched, in order to form tear tabs and predetermined tear lines. Finally, the sealed composite, together with the administration forms positioned according to the pattern, is separated from the following webs.

BRIEF DESCRIPTION OF THE DRAWING FIGURES

Figure 1A:
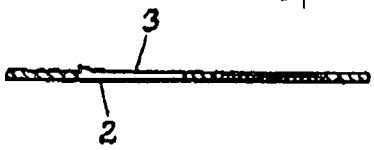
Figure 2:
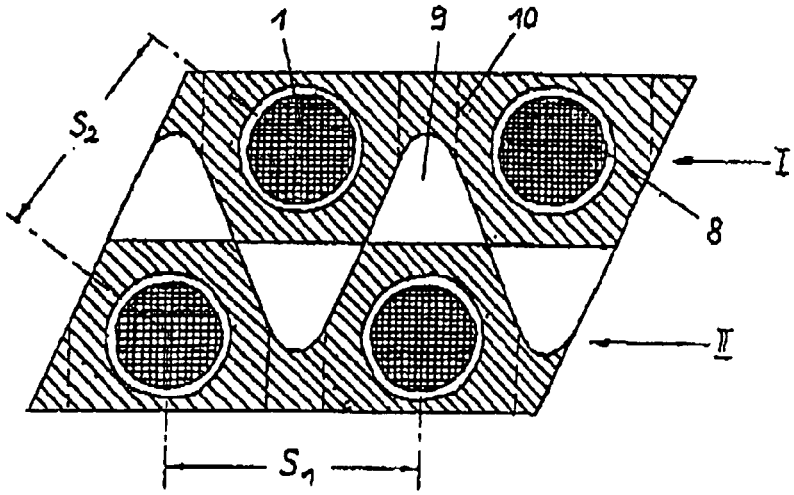
Figure 3:
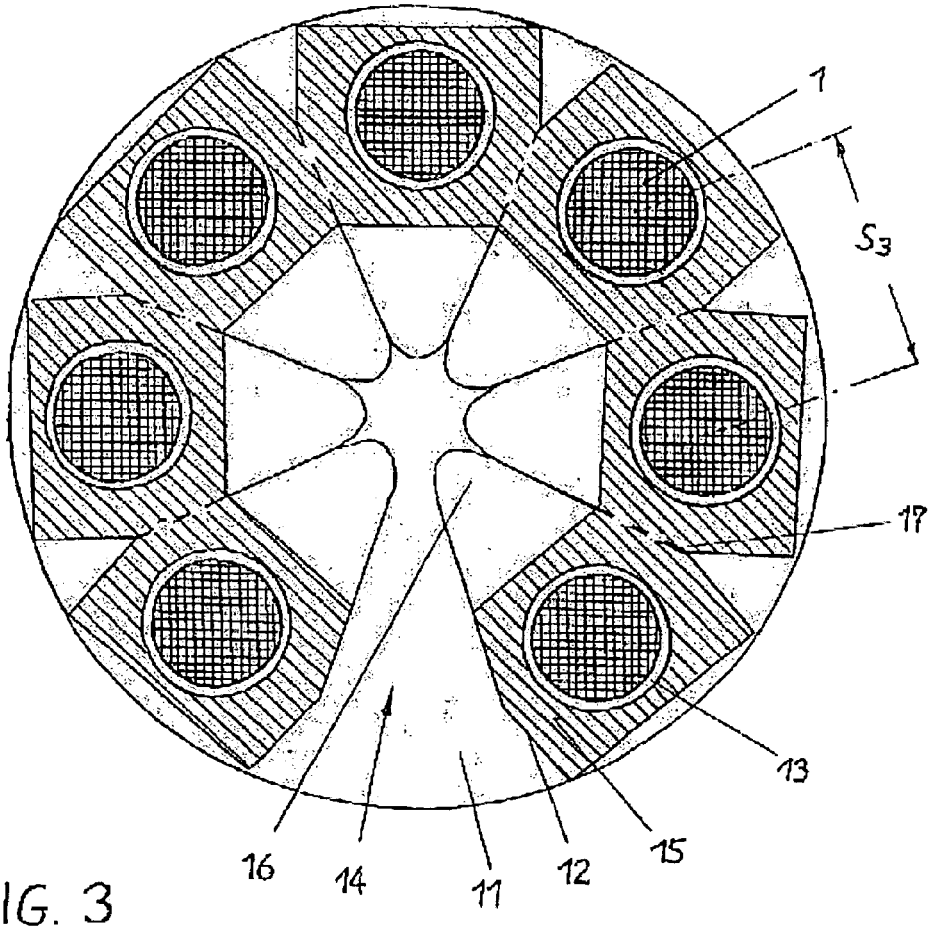

The invention will be illustrated in the following by means of examples of embodiments. In the appended drawings FIG. 1 shows a primary package unit in a first embodiment, FIG. 1*a* shows a section along A-A through the same;

FIG. 2 shows a primary package unit in a second embodiment;

FIG. 3: shows a primary package unit in a third embodiment, and

Figure 4:
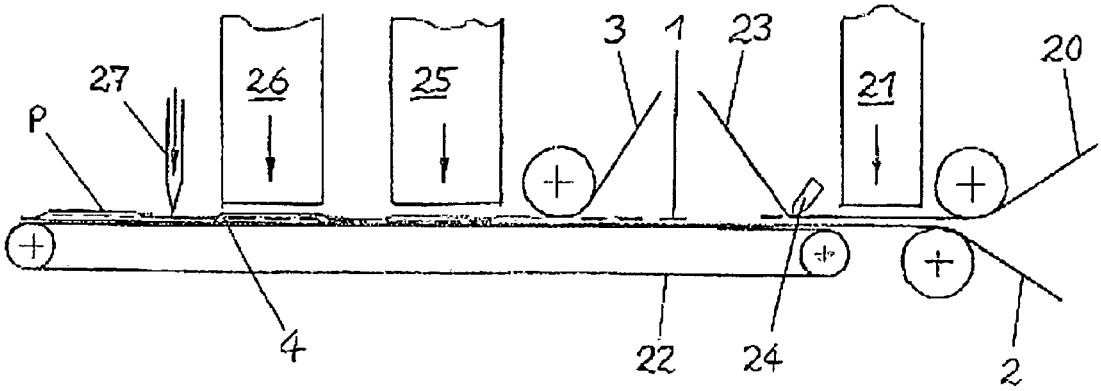

FIG. 4: a scheme of a process sequence for manufacturing a primary package unit.

DETAILED DESCRIPTION

FIG. 1, in conjunction with FIG. 1*a*, shows a primary package unit with five circular film laminas as administration forms arranged in two rows I and II and having a diameter of 1.9 cm and a thickness of 200 μm. The administration forms 1, 1*a*, 1' of the two rows I and II are positioned offset from each other, the offset corresponding to half the distance S (S=3,6 cm) between the centre points of two neighbouring administration forms e.g., 1, 1*a* of a row I or II, and thus amounts to 0.5 S=1.8 cm. In addition, respective three neighbouring administration forms 1, 1*a*,1' are positioned such that they form an isosceles triangle, so that also the neighbouring administration forms e.g., 1, 1*a* of both rows I and II are at a distance S from one another. The distance between their borders is 1.7 cm. The primary package unit is formed of a bottom layer 2 of a composite of paper, aluminium and polyethylene, with a thickness of 500 μm, and of a top layer 3, sealed to the bottom layer, of a composite of polyethylene terephthalate, polypropylene and polyethylene, with a thickness of 70 μm, between which compartments 4 for the administration forms 1, 1*a*, 1' are formed, in the area of which the two layers 2 and 3 are not sealed to one another. The diameter of the compartments 4 is 2.2 cm and is thus greater than that of the administration forms 1, 1*a*, 1', so that an annular space of air 5 is present which surrounds the administration forms. Associated to the compartments 4 are tongue-shaped sections 6 of the top layer 3, which are not sealed to the bottom layer 2 and which in the region of their tip pointing away from the respective compartment 4 are separated from the remaining top layer 3 and serve as gripping and tearing tabs. In addition, the tongues verge on the side facing the respective compartment 4 on predetermined tear lines which are formed at both sides of a compartment 4 in the top layer 3 that is sealed with the bottom layer 2. The tongue-shaped tear tabs (6) each project into the spaces existing between the compartments 4 of the respective other row I or II.

FIG. 2 shows a primary package unit with only four compartments 8 and administration forms 1, wherein the latter are at a greater distance from each other than in the afore-described embodiment. The distance between the administration form 1 of a row I or II accommodated in the compartments 8 is $S_1$=4.5 cm, and that between the administration forms 1 of the two rows I and II amounts to $S_2$=4 cm. The tear tabs 9, which are formed as in the embodiment of FIG. 1, verge on respective separate predetermined tear lines 10 by contrast to the tear tabs (6).

FIG. 3 shows a primary pack of a bottom layer 11 of a composite of paper, aluminium and polyethylene, with a thickness of 500 μm and with a top layer 12, sealed with said, bottom layer, of a composite of polyethylene terephthalate, polypropylene and polyethylene with a thickness of 70 μm and with seven compartments 13 arranged in a ring-shape between the layers, as well as seven administration forms 1 accommodated in said compartments. This primary pack represents a week-pack, from which one administration form 1 is to be removed each day. The arrangement of the compartments 13 is such that their centre points lie on a circle of diameter 9.5 cm, and that they are situated at a uniform distance $S_3$ of 3.5 cm from one another. The top layer 12 is recessed in the area of a gap 14 resulting from the predetermined number of administration forms and from the dimensioning, and in the shaded regions 15 is sealed to the bottom layer 11. This primary packaging, too, is provided with tongue-shaped tear tabs (16) formed by unsealed sections 16 of the top layer 12, which tabs are separated from each other and all of which point towards the centre. Between the compartments 13, predetermined tear lines 17 are formed in the sealed area.

FIG. 4 shows the process sequence for producing a primary package unit. To manufacture the said unit, web-shaped material of the medicament, which is stocked on rolls, is provided to form the bottom layer 2 (11) and the top layer 3 (12). The medicament web 20 is intermittently fed to a punching station 21 in a predetermined cycle, and is combined with the web-shaped material of the bottom layer 2 before reaching the punching station where (21) circular administration forms 1, corresponding to the predetermined packaging pattern of the primary package unit according to FIG. 1, FIG. 2 or FIG. 3, are punched out on the web of material of the bottom layer 2. The web of material of the bottom layer 2 is advanced, in time, by a transport mechanism 22, not represented in detail. By guiding the web 23 of remaining material around a detachment edge 24, which has a small diameter, the administration forms 1 are separated and lie in the predetermined packaging position on the web of material of bottom layer 2. Thereafter, likewise in time, the web of material of top layer 3 is fed onto the said bottom layer as a cover layer, and is sealed with the web of material of the bottom layer 2 in a sealing station 25 in accordance with a predetermined pattern, both the regions for forming the compartments 4 (13) as well as the regions wherein the tear tabs 6 (16) are formed remaining unsealed. Thereafter the web of the top layer is partially punched at a punching station 26 according to a predetermined pattern to form predetermined tear lines 7 (10, 17), and is punched trough in order to separate the tear tabs (16). In a subsequent cutting station 27, the thus-configured primary package unit P is separated from the following one.

LIST OF THE REFERENCE NUMBERS USED

I row
II row
S distance
1 administration form
2 bottom layer
3 top layer
4 compartment
5 air space
6 tear tab
7 predetermined tear line
8 compartment
9 tear tab
10 predetermined tear line
11 bottom layer
12 top layer
13 compartment
14 gap
15 region
16 tear tab
17 predetermined tear line
20 web of medicament
21 punching station
22 transport mechanism
23 web of remaining material
24 detachment edge
25 sealing station
26 punching station
27 cutting station
P primary package unit

The invention claimed is:

1. A primary package unit for a plurality of separated medicinal administration form which are in the form of wafers, said package unit having a bottom layer and a top layer sealed thereto, between which layers a plurality of individual compartments, surrounded by sealed regions, are formed for the administration forms in the region of which the top and bottom layers are unsealed, said primary package unit being provided with at least two rows (I, II) of compartments (4, 8), and the compartments (4, 8) and administration forms (1, 1*a*, 1') of neighbouring rows (I, II) are arranged in a staggered arrangement which results in an offset between said rows, wherein said bottom layer and said top layer are both flexible, and wherein said package unit has top layer sections associated with the compartments (4,8) and not connected with the bottom layer (2), each of said top layer sections having a region facing away from its associated compartment, which top layer sections are separated from top layer (3) and serve as tear tabs (6,9), said tear tabs (6,9) bordering on predetermined tear lines (7, 10), which are arranged in the sealed top layer (3) of the regions surrounding the compartments (4,8) and wherein said tear tabs (6,9) each project into the spaces existing between the compartments (4,8) of a neighbouring row (I, II).

2. The primary package unit according to claim 1, wherein each of said wafers (1, 1*a*, 1') has a centre point, and the rows (I, II) of compartments (4) are arranged such that the offset of the administration forms (1,1') of said neighbouring rows (I, II) corresponds to half a distance (S) between the centre points of two neighbouring administration forms (1, 1*a*) of one of said rows (I, II), and that all neighbouring administration forms (1, 1*a*, 1') are arranged at equal distance (S) from one another.

3. The primary package unit according to claim 1, wherein each of said administration forms (1, 1*a*, 1') has an outer border, and said administration forms are arranged such that the distance between the borders of two neighbouring administration forms (1, 1*a*, 1') is between 3 mm and 50 mm.

4. The primary package unit according to claim 1, wherein the bottom layer and/or the top layer are made of a material selected from the group consisting of polyethylene (PE), polyethylene terephthalate (PET), polypropylene (PP), ethylene vinyl acetate copolymer (EVA), paper, aluminium, and composites of these materials.

5. The primary packaging according to claim 1, wherein the top layer (3, 12) and/or the bottom layer (2, 11) is made of a transparent material.

6. The primary package unit according to claim 1, wherein each of said administration forms (1, 1*a*, 1') has an outer border, and said administration forms are arranged such that the distance between the borders of two neighbouring administration forms (1, 1*a*, 1') is between 6 mm and 20 mm.

* * * * *